United States Patent [19]

Hahn

[11] Patent Number: 4,757,642

[45] Date of Patent: Jul. 19, 1988

[54] SELF-CLOSING SLIDING DOOR SYSTEM

[75] Inventor: Michael D. Hahn, Beatrice, Nebr.

[73] Assignee: The Store Kraft Manufacturing Company, Beatrice, Nebr.

[21] Appl. No.: 18,714

[22] Filed: Feb. 25, 1987

[51] Int. Cl.[4] ..... E05D 13/04

[52] U.S. Cl. ..... 49/449; 16/77; 16/DIG. 17; 49/404; 312/319

[58] Field of Search.....49/404, 445, 449; 312/319; 16/72, 77, DIG. 17

[56] References Cited

U.S. PATENT DOCUMENTS

| | | | |
|---|---|---|---|
| 2,609,193 | 9/1952 | Foster | 49/445 X |
| 2,786,240 | 3/1957 | Tobiasz . | |
| 2,895,779 | 7/1959 | Bender . | |
| 3,011,223 | 12/1961 | Bender . | |
| 3,150,420 | 9/1964 | Brenner | 49/445 |
| 3,452,480 | 7/1969 | Foster | 49/445 |
| 3,475,865 | 11/1969 | Arnes | 45/445 |
| 3,618,262 | 11/1971 | Tuhro | 49/404 |
| 3,992,751 | 11/1976 | Foster et al. | 16/197 |
| 4,004,372 | 1/1977 | Beard et al. | 49/404 |
| 4,227,345 | 10/1980 | Durham, Jr. | 49/181 |
| 4,330,960 | 5/1982 | Hasemann et al. | 49/404 |

OTHER PUBLICATIONS

"Spring-Power Packages", Ametek, Hunter Spring Division, 2 pages, No date.

*Primary Examiner*—Philip C. Kannan

*Attorney, Agent, or Firm*—Cushman, Darby & Cushman

[57] ABSTRACT

For self-closing a sliding door, e.g. of a showcase, combinations of belts and sprockets, cables and pulleys, rods and springs and the like, which have proved difficult to construct, service and replace are replaced by one or more constant force springs associated with a spring-retention cavity or other spring retainer. This permits the doors to be easily removed for servicing and for improved access to the interior of the showcase. Upon door removal, no self-closing apparatus still links the door to the case. The parts are simple and easy to replace, few moving parts are involved and the system is applicable both for new construction and for retrofitting to existing cases.

7 Claims, 4 Drawing Sheets

NOTE: DOOR SHOWN IN THE LOCKED POSITION

SELF-CLOSING SLIDING DOOR SYSTEM

BACKGROUND OF THE INVENTION

This invention relates to the independent operation of individual doors utilizing the self-closing feature on sliding doors and the optional employment of a self-activating locking device.

To appreciate the solution which has resulted from the present invention, one must first understand the problems existing self-closing door systems have created. For example, fine jewelry showcases previously have had self-closing door systems installed, but because of the complexity of their construction, replacement and service of the self-closing components by store personnel was for the most part impossible. Combinations of cable and pulley, belts and sprockets, rods and springs, etc. and the periodical failure of the individual parts would in most instances require replacement by a manufacturer's service technician. Removal of doors from showcases was very difficult, thus making merchandising of the unit difficult.

SUMMARY OF THE INVENTION

For self-closing a sliding door, e.g. of a showcase, combinations of belts and sprockets, cables and pulleys, rods and springs and the like, which have proved difficult to construct, service and replace are replaced by one or more constant force springs associated with a spring-retention cavity or other spring retainer. This permits the doors to be easily removed for servicing and for improved access to the interior of the showcase. Upon door removal, no self-closing apparatus still links the door to the case. The parts are simple and easy to replace, few moving parts are involved and the system is applicable both for new construction and for retrofitting to existing cases.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Preferred embodiments of the invention will now be described in further detail, in relation to the close-to-the-left/open-to-the-right one of the two overlapped vertically-oriented, horizontally sliding doors of a case, such as a showcase for fine jewelry. The same structure could be provided (with laterally-reversed orientation) for the other one of these doors, and it could be provided on a similar door which is the sole door for a case, on a door which is a front, either side, top or bottom door for a case, or on a door which closes an aperture for some other structure than a case, e.g. a patio door in a wall of a house, an animal cage door, a garage door or the like.

Figure 1:
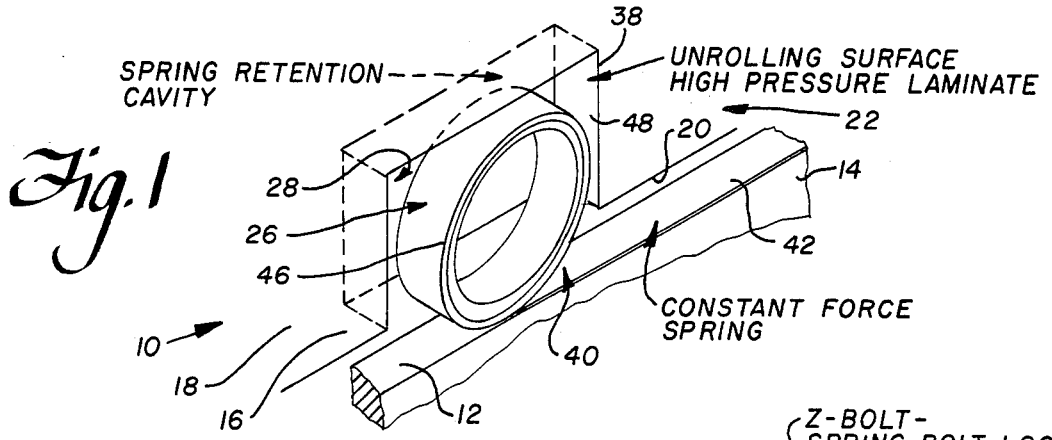
FIG. 1 is a fragmentary perspective view of a first embodiment of a sliding door self-closing system embodying principles of the present invention.

As shown in rudimentary form in FIG. 1, a first embodiment 10 of the system of the invention is provided between the upper edge 12 of a sliding door 14, and an upper track 16 of a frame 18 of an aperture 20 of a case 22, access to which, or to a respective portion of which is controlled by the sliding door 14. As seen from the rear, i.e. from the perspective of a behind-the-counter sales person, the door 14 is a slide-to-the-right to open/-slide-to-the-left to close-type of door, which may be one of a set of two (i.e. the one leftmost when both are closed) for a fine jewelry showcase.

Although not shown in detail (due to its conventional and believed-widely understood constructional make-up, the apertures of such cases (or equivalent framed apertures for sliding doors) often have a lower, upwardly-opening track for each door, which normally receives a lower marginal edge region of the respective door, and an upper, downwardly-opening track for each door, which normally receives an upper marginal edge region of the respective door. Where such doors are provided in pairs, often the lower tracks will be provided as adjacent portions of a unitary track structure; likewise for the upper tracks. Usually at least one of the tracks for a door includes bearing means to facilitate door sliding action. Sometimes such bearing means simply takes the form of track structures or surfaces molded of lubricous synthetic plastic material; in many instances roller bearings are provided in the lower track (if the weight of the door is borne by the lower track) or in the upper track (if the weight of the door is hung from the upper track and the lower track merely serves as a guide). In most instances, sliding doors may be removed from the tracks by lifting the door vertically upwards until its lower marginal edge clears an inner lip of the lower track, whereupon the door, while so lifted, can be rotated bottom edge-inwards until its lower edge is completely clear of the lower track. Then the door may be lowered until its upper edge clears an inner lip of the upper track and rotated top edge-inwards to completely free the door from the track. Reinstallation of such a door is accomplished by a reversal of the above-stated procedure. Not all such doors are hung in exactly the same way. Variations include ones where the door must be slid to a particular location before it can be lifted, where some device must be unlocked, manipulated or removed before the door can be lifted, and the like. The principles of the present invention are widely applicable to practically all such conventional sliding door assemblies.

Apart from the details to be mentioned, the structure of the case and door may be utterly conventional, and so the conventional structure is illustrated in rudimentary form, or omitted, in order to avoid cluttering the views. For instance, the lower track of the case has not been depicted, and the upper track has been depicted only by depicting the upper back rail 24 which may form a part of (or may form a support for) the upper track 16. The above-mentioned lip of the upper track, being conventional structure, is an example of a non-depicted conventional detail.

In FIG. 1, a simplified form of the invention is illustrated. In this figure a constant force spring 26 is shown received in a downwardly-open well 28 formed through the upper track, i.e. in the upper back rail 24 of the case (i.e. in an overlying portion of the upper horizontal member of the frame 18 of the aperture 20 which is controlled by the door 14. In the instance depicted the well 28 is a vertically-extending mortise-like slot centered (in a front-to-rear sense) in the rail 24, opening through its lower edge 30 near the overlap end 32 of the door (i.e. if the door is to slide open to the right, the inverted well 28 is formed in the rail near the right end of the door).

In addition to front and rear cover plates (not shown, and which may be provided by other conventional structure, the inverted cavity or well 28 is seen having an upper end 34, and two opposite, generally vertical end walls 36, 38 which respectively are further from and closer to the overlap end 32 of the door (i.e. is disposed further along than the end wall 36 in the direction towards which the door slides open).

Although a constant force spring may be an item that is unfamiliar to some, in fact, it is an item which has become commercially available in recent years, e.g. the NEG'ATOR® constant force extension spring available in the USA from the Hunter Spring Division of Ametek, Inc. Competitor's products or ones having comparable capabilities for the intended use could be used.

Figure 2:
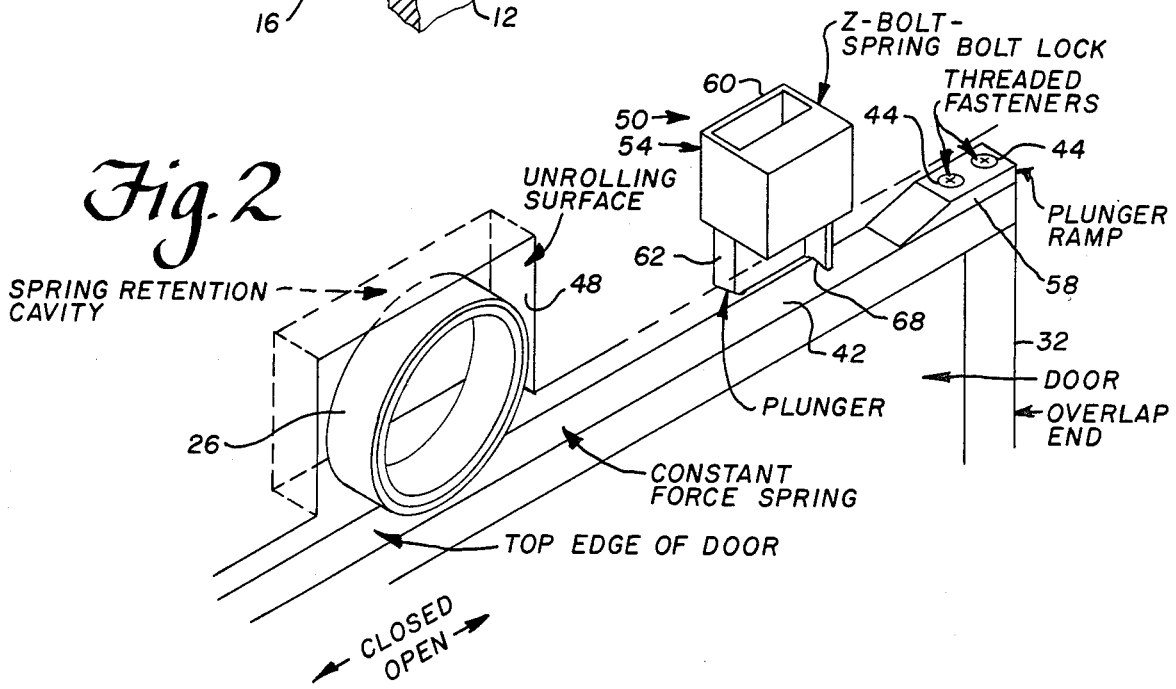
FIG. 2 is a fragmentary perspective view of the sliding door self-closing system shown in FIG. 1, also provided with an optional self-locking device.

In general, the spring 26 is a multi-turn, convolute-wound, i.e. coiled strip 40 of resilient, i.e. elastically-deformable material, e.g. spring steel, the radially outermost turn of which ends in a tangentially extending tongue 42. Adjacent its free end, the tongue 42 of the spring 26 is secured, e.g. by screws 44 (FIG. 2), to the door 14 on the upper edge 12 of the door 14, near the overlap end 32 of the door 14, and the coil portion 46 of the spring 26 is received in the inverted well or cavity 28, e.g. as shown. The diameter of the coil is not so important as is the uncoiled length of the strip 40. The unstressed, relaxed, 'memorized' condition of the spring 26 is shown in FIG. 1. The length of the strip must be such that as the door 14 is manually slid to the right from a normally fully closed condition to a fully open condition, so that the coil 46 is progressively uncoiled onto the upper edge 12 of the door 14 (effectively progressively, temporarily decreasing the turns of the coil 46 while correspondingly lengthening the tongue 42) enough of the coil remains, e.g. at least one full turn, so as to permit self-initialed recoiling of the coil 46 into the cavity 28 (and corresponding decreasing of the length of the tongue) as the door is released. Inasmuch as such action necessarily is accompanied by shortening of the distance along the upper edge of the door 14 from the coil 46 to the connection 44, the restoration force which recoils the spring also slides the door 14 to the left, to the closed position which is shown in FIG. 1.

In order to decrease the coefficient of friction between the radially outer surface of the outer convolute turn of the coil 46 and the wall 38 of the cavity 28, and in order to decrease wear on the wall surface, various measures may be taken, such as plating the wall 38 with a low friction wear plate 48, such as a one made of high presure laminate, e.g. the sort of material as that used for plating kitchen countertops. Formica® and Micarta® are but two of many brands of such material. Other low-friction/durable materials could be used for making the plate 48 and, in some instances, the material of the upper back rail may be such that no added low-friction wear plate is needed for the wear-receiving coil rolling-/unrolling surface in the cavity. The plate 48 may be force-fit into place and/or held by the same sort of adhesive used for plating such laminate to the underlayment base stock of kitchen countertops.

It should go without saying, but the restoration force provided by the spring 26 must lie intermediate that which would make the door too difficult to slide open and comfortably manually maintain open, and that which would be ineffective for overcoming the heat losses and friction tending to prevent complete reclosing of the door when the person who is holding it open lets go of it.

FIGS. 2–5 show the apparatus of FIG. 1, with an optional elaboration in the form of a self-locking lock 50.

Figure 3:
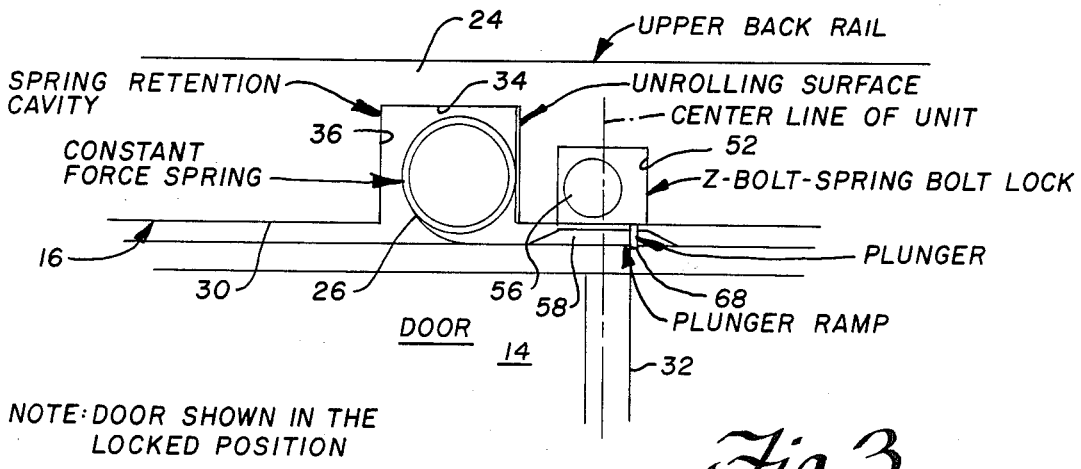
FIG. 3 is a fragmentary rear elevation view of a showcase provided with the locking device-equipped sliding door self-closing system of FIG. 2, the door being shown closed and locked in this view.
Figure 4:
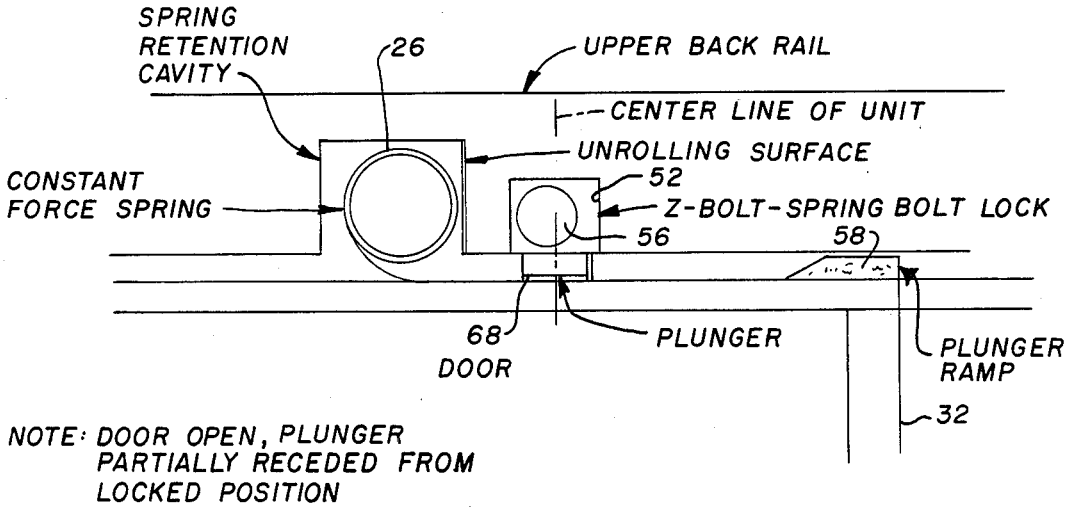
FIG. 4 is a similar view of the showcase of FIG. 3, showing a different stage of operation, at which the door is slid to a half open (half closed) position, with the lock unlocked.
Figure 5:
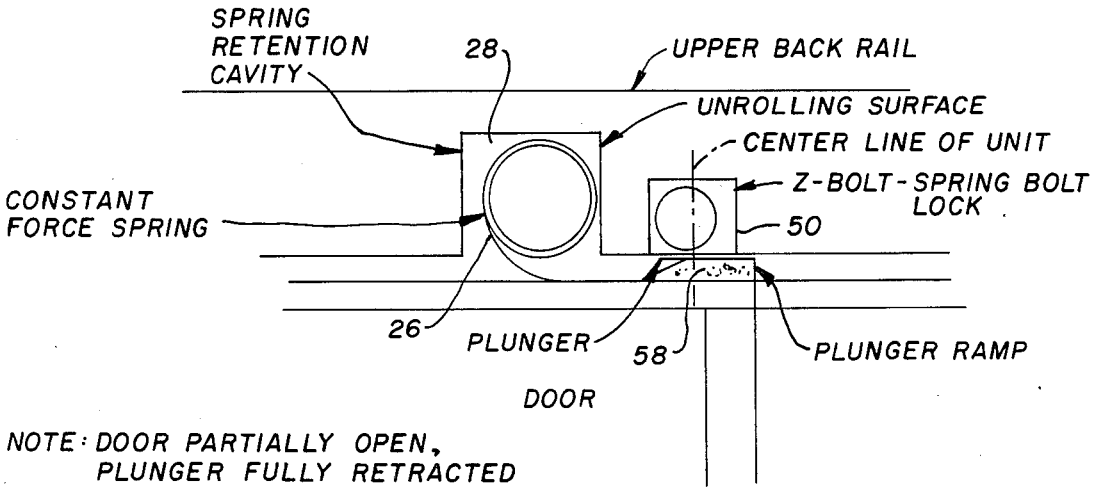
FIG. 5 is a similar view of the showcase of FIGS. 3 and 4, showing a stage intermediate that of FIGS. 3 and 4, at which the lock is unlocked and the door is just beginning to be slid open (or is nearly shut and the lock about to self-lock)

In this elaborated embodiment, a second inverted well or cavity 52 is formed in the upper back rail between the spring coil-receiving cavity 28 and the situs of the overlap end of the door 14 when the door 14 is fully closed. A commercially available lock, preferably a so-called Z-bolt spring bolt lock 54 is mortised into the cavity, with its lock-cylinder key-accessible from the rear, as at 56. In installing the screws 44 which mount the tongue of the spring 26 to the upper edge of the door 14, the screws 44 are installed through a plunger ramp 58. (In practice, the lock 54, including its cylinder 56, its ramp 58 and screws 44 are commercially available as a kit or set of parts from one or more lock manufacturers in the U.S. In general, the lock 54 includes a housing 60 from which a vertically-movable plunger 62 protrudes in a downward direction. When the plunger, which is spring-urged towards a fully downwardly-extended condition reaches that condition, a portion of the lock assembly (not shown, within the housing 60) automatically activates in a sense to prevent the plunger from being raised unless and until a key is inserted in the lock cylinder and turned. The configuration of the plunger 62, and the mounting of the lock housing in the cavity 52 is such that if the plunger is key-raised to clear ramp 58 and the door 14 is simultaneously slid to the right, the plunger can lower sufficiently to ride on the upper suface of the ramp 58 and on the upper surface of the tongue 42 of the spring 26 (FIG. 4), but insufficiently to automatically re-lock. But when the clerk lets go of the slid-open door 14, so that the door 14 begins to be automatically slid closed by the recoiling spring 26, as the partly thrust plunger 62 reaches the ramp 58, the ramp further forcibly retracts the plunger 62 (FIG. 5), until its edge portion 68 clears the far end of the ramp 58, whereupon, the plunger is free to extend downwards, and is forced by the lock's spring (not shown) and gravity to extend downwards sufficiently for the lock to automatically relock (FIG. 3). Due to the relative positions of the lock assembly parts as mounted to the case and the door, the position of the door when the lock automatically relocks is the fully-closed position of the door.

Figure 6:
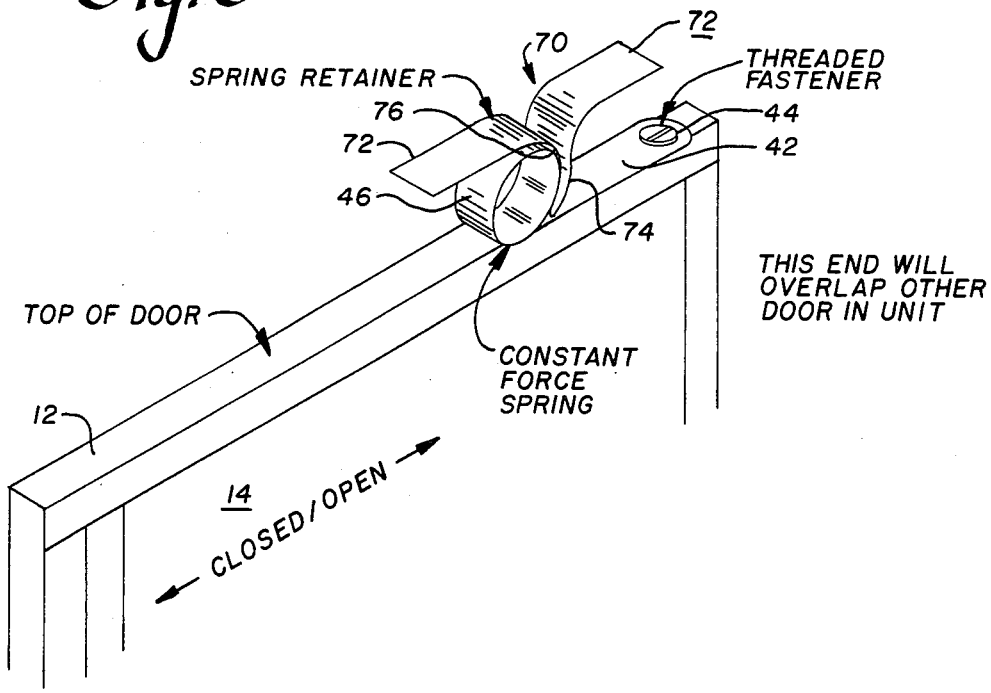
FIG. 6 is a fragmentary perspective view of a second embodiment of a sliding door self-closing system embodying principles of the present invention.
Figure 7:
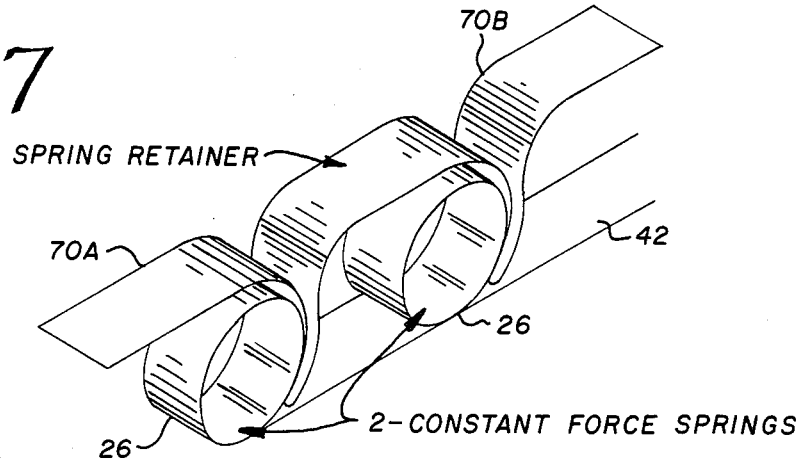
FIG. 7 is a fragmentary perspective view of a third embodiment, in which the constant force spring of the FIG. 6 embodiment is provided in plurality.
Figure 8:
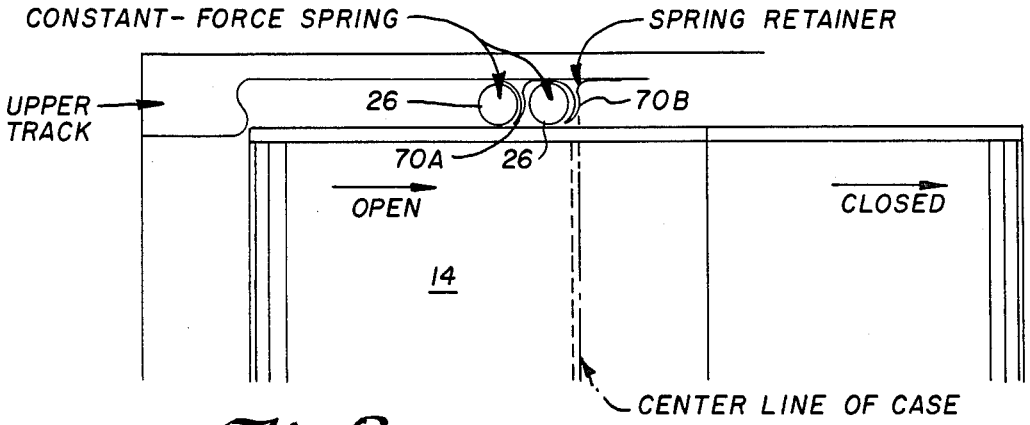
FIG. 8 is a fragmentary rear elevation view of a showcase having a door provided with the sliding door self-closing system of FIG. 7, the particular door (the one at the left) being shown slid to a partly-open state.
Figure 9:
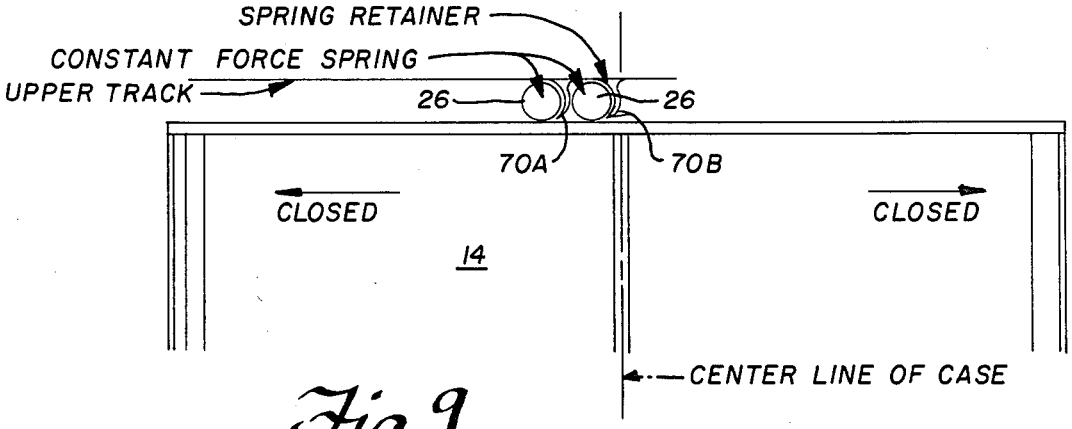
FIG. 9 is a fragmentary rear elevation view of the showcase of FIG. 8, with the particular door slid closed.

Another embodiment of the system of the present invention is shown in FIG. 6. In this embodiment, the structure and function of the spring-retention cavity in the upper rear rail, and its unrolling surface, described above in relation to FIG. 1, are replaced by and provided by a spring retainer 70. This item may be formed of metal or plastic and preferably includes two oppositely-extending tongues 72 which can be mounted by any convenient means such as adhesive or screws to the case frame, e.g. in the upper track near the location of the overlap edge of the door when fully closed. Between the tongues 72, the spring retainer includes a curved portion 74 which looks generally like the curl of a breaking wave. The working face of the curved portion 74 of the spring retainer 70 is its concave face 76 against which the spring coil 46 rolls and unrolls.

In the elaboration which is shown in FIGS. 7–10, two springs 26 are provided, in tandem, having overlapped tongues secured in common to the upper edge of the door at the same site. The springs 26 coil and uncoil against respective ones of a series of two spring retainers 70A and 70B, which may be provided as respective portions of an integral structure (as shown), or as duplicate replications of the spring retainer 70 or (less logically) as one spring retainer 70 and one spring retention cavity/unrolling surface structure as shown in FIG. 1, or as a series of two spring retention cavities/unrolling surface structures (i.e. a tandem replication of the structure shown in FIG. 1). The purpose of providing the spring and rolling/unrolling surface structure in plurality is to correspondingly beef-up the force for automatically reclosing the sliding door.

Any of the embodiments may use the optional lock structure which is shown in FIGS. 2–5.

The unrolling surface of the wear plate of FIGS. 1–5 may be curved as is the comparable surface of the spring retainer shown in FIGS. 6–10, and vice versa.

As indicated hereinabove, the system of the invention can be provided on all doors in a set, or only on less than all doors in a set, and it may be provided on sliding doors having other spatial orientations and for other controlled apertures than for a showcase.

Figure 10:
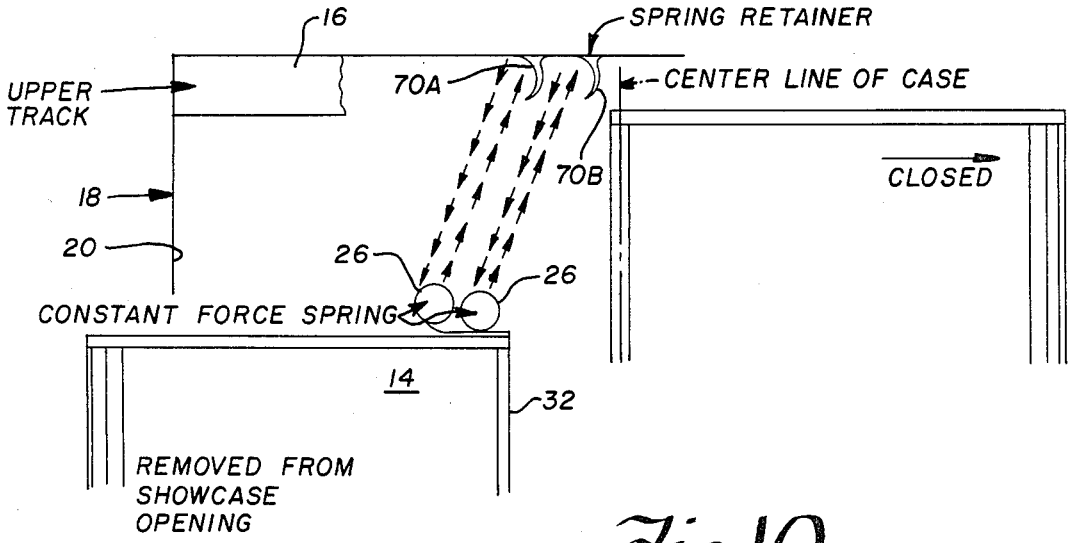
FIG. 10 is a partly exploded, fragmentary rear perspective view of the showcase of FIG. 8, showing the particular door demounted from the case.

Removal of the sliding door from the track requires that it be partially open (FIG. 10). At this position, the door is raised upward within the lower and upper track. The lower edge of the door is pulled out until the lower track is cleared. Pulling down on the door slowly will reveal the top edge of door. As the constant force spring becomes visible the forefinger is inserted through the center of the coil holding the spring in place. The door then can be removed and the spring is manually allowed to recoil itself.

To install a door it is positioned to allow the constant force spring to enter the spring retention cavity or fabricated spring retainer, the installation is completed following the removal procedure in reverse order.

It should now be apparent that the self-closing sliding door system as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A self-closing sliding door system, comprising:

a frame defining an aperture;

a door mounted in said frame for bidirectional sliding movement along a path for opening and closing said aperture;

said door having an edge surface aligned with said path;

a coil spring having a relaxed state in which said spring comprises a coil portion having a plurality of convolute-wound turns and a tongue extending generally targentially from an outermost turn of said coil portion to provide a free end for said coil spring;

said frame having a surface aligned with said path;

means securing said free end of said coil spring to one of said door and said frame so as to dispose said coil spring for unrolling along the respective said surface as said door is slid along said path for opening said aperture;

means fixed to the other of said door and said frame and projecting therefrom transversally of said path into engaging relation with said coil portion for retaining said coil portion against movement along said path and for providing a surface against which said coil is disposed to roll as said coil spring rolls and unrolls for correspondingly lengthening and shortening said tongue;

a manually unlockable, self-locking normally fully thrust lock plunger mounted to said other of said door and said frame; and a keeper mounted to said one of said door and said frame at a position relative to said lock plunger which permits said lock plunger to fully thrust into a kept condition in relation to said keeper only when said door fully closes said aperture, and said tongue being interposed for thrust-inhibiting relation with said lock plunger when said door is slid sufficiently along said path that said lock plunger has cleared said keeper.

2. The self-closing sliding door system of claim 1, wherein:

said retaining means comprises a bracket mounted to said frame.

3. The self-closing sliding door system of claim 1, wherein:

said coil spring is provided in plurality in a series extending along said path, said means securing said free end secures the free ends of all of said coil springs, and said retaining means is provided in a corresponding plurality.

4. The self-closing sliding door system of claim 1, wherein:

said keeper comprises a plunger end-guiding ramp at an end thereof disposed for forcing partial retraction of said plunger as said door, when sliding in a closing direction, is nearly fully closed.

5. The self-closing sliding door system of claim 1, wherein:

said retaining means comprises a cavity formed in said frame.

6. The self-closing sliding door system of claim 5, wherein:

said cavity is defined in part by a low-friction durable wear surface as said surface against which said coil portion is disposed to roll.

7. The self-closing sliding door system of claim 6, wherein:

said wear surface is provided by a plate of high pressure laminate.

* * * * *